US005288346A

United States Patent [19]

Nizhnikovskaja et al.

[11] Patent Number: 5,288,346

[45] Date of Patent: Feb. 22, 1994

[54] PROCESS FOR PRODUCING DEFORMABLE WHITE CAST IRON

[75] Inventors: Polina F. Nizhnikovskaja; Leonid Snagovski; Yuri Taran; Tatyana Mironova, all of Dnepropetrovsk; Michael Loiferman, Ezhevsk; Kasimir Zhdanovich, Ezhevsk; Galina Demchenko, Ezhevsk, all of U.S.S.R.

[73] Assignee: DMK TEK, Inc., Ann Arbor, Mich.

[21] Appl. No.: 993,959

[22] Filed: Dec. 17, 1992

Related U.S. Application Data

[63] Continuation of Ser. No. 692,560, Apr. 29, 1991, abandoned.

[51] Int. Cl.[5] ..... C21D 5/04; C21D 8/00

[52] U.S. Cl. ..... 148/540; 148/544

[58] Field of Search ..... 148/2, 321, 322, 324, 148/538, 540, 544, 612, 653, 654, 321, 323, 616–617; 420/12

[56] References Cited

U.S. PATENT DOCUMENTS 3,423,250 1/1969 Morizumi et al. ..... 148/2
4,030,944 6/1977 Sommer et al. ..... 148/2

FOREIGN PATENT DOCUMENTS 0779428 11/1980 U.S.S.R. ..... 420/12
1117025 6/1968 United Kingdom ..... 148/322

OTHER PUBLICATIONS

"Deformable Moderately Alloyed White Irons" by Yu. N. Taran, Metallovedenie i termicheskaya obrabotka metallov, 1989, No. 5, pp. 35–43 (text in Russian) (article with English Translation).

*Primary Examiner*—R. Dean
*Assistant Examiner*—Sikyin Ip
*Attorney, Agent, or Firm*—Harness, Dickey & Pierce

[57] ABSTRACT

A process for deforming white cast iron. A melt is prepared containing iron, carbon and one or more alloying elements. The melt is cooled at a rate of approximately 2° C. per minute or faster to form a white cast iron material. The white cast iron material is annealed at a temperature of about 100° C. to about 400° C. below the solidus temperature of the white cast iron material. The white cast iron is plastically deformed.

8 Claims, 3 Drawing Sheets

PROCESS FOR PRODUCING DEFORMABLE WHITE CAST IRON

This is a continuation of U.S. patent application Ser. No. 07/692,560, filed Apr. 29, 1991, now abandoned.

TECHNICAL FIELD

This invention relates to ferrous metallurgy, and more particularly to a process for producing deformable white cast iron.

BACKGROUND

The present invention relates to an improved process for producing plastically deformable, or malleable, white cast iron. The process advantageously allows for the manufacture of products heretofore impracticable using conventional methods, e.g., products (such as approximately 2 mm thick sheet, or wire having a diameter of approximately 2 mm) resulting from deformation using high reduction ratios during manufacture.

When alloyed with known carbide formers, white cast iron tends to exhibit high hardness and wear resistance, but often has less than desirable mechanical performance characteristics and low fatigue strength. Further, notwithstanding such properties, commercial scale plastic deformation of such white cast iron often is constrained due to a relatively low deformability of the material, which is believed to be caused by the presence in its structure of a eutectic-formed brittle phase.

One process for producing deformable white iron is described in Yu.N. Taran, et al. "Deformable Moderately Alloyed White Irons" in Metallovedenie i termicheskaya obrabotka metallov, 1989, No. 4, pp. 35–43. The process is believed to involve alloying iron with chromium and vanadium, which are dissolved in eutectic cementite, to make the latter oversaturated and soluble during further annealing and plastic working.

This process however, is believed to be limited because it does not control specific microstructural transformations, and thus is not believed to be commercially practicable. For instance, plastic deformation of this iron is believed to be possible only within a narrow temperature range, which is difficult to achieve and maintain for commercial scale deformation.

Another process for producing deformable white iron is disclosed in DE,1287593. According to that process, a material is prepared containing, by weight, 1.7 to 3.8 percent carbon; 0.4 to 2.5 percent silicon; less than 1.0 percent manganese; less than 2.0 percent chromium; less than 2.0 percent molybdenum; less than 1.0 percent vanadium; less than 1.0 percent tungsten, with the balance being iron. The process is believed to require heating an ingot to a temperature which is 50° C. below the solidus temperature and carrying out plastic deformation in a temperature range of 900° to 1125° C. The plastically deformed ingot is subsequently slow cooled.

The above mentioned process allows for large-size rolls to be press formed from white cast iron ingots. However, the process is believed to be limited to low amounts of deformation and low deformation rates.

SUMMARY OF THE INVENTION

Disadvantages known in the art for producing deformable white cast iron are overcome by the process and composition of the present invention. The process include the steps of preparing a melt which includes iron, carbon and a carbide forming alloying element. The melt is cooled at a rate of at least about 2° C. per minute at the core of the material to form a white cast iron material. The white cast iron material is annealed at a temperature of about 100° C. to about 400° C. below the solidus temperature of the white cast iron material. The ingot is worked plastically.

It is believed that by employing the specific composition described herein and controlling the heating and loading of resulting cast iron material, substantially improved control over the microstructure in the material is advantageously obtained, and thereby yields a material capable of being plastically deformed to unexpectedly high degrees of deformation. The use of the process of this invention permits the production of deformable white cast iron on an economical and commercially practicable basis, such as desired when manufacturing in high-speed mills. Products such as work-rolls having diameters of 90 mm or larger, and the like, can be manufactured with white cast iron produced according to this invention. Products calling for high amounts of deformation, e.g. high reduction ratios (such as sheets 2 mm thick and wire 2 mm in diameter) can also be made efficiently and on a commercial scale. Products prepared according to the process of the present invention exhibit relatively high hardness (as high as $R_c68$), high strength (e.g. about 1550 MPa), good wear resistance and hardenability. Higher rates of deformation are also possible as compared with conventional white cast iron.

Further objects, features and advantages of the invention will become apparent from a consideration of the following description and the appended claims when taken in conjunction and the accompanying drawings.

DETAILED DESCRIPTION OF THE PREFERRED EMBODIMENT

Figure 1:
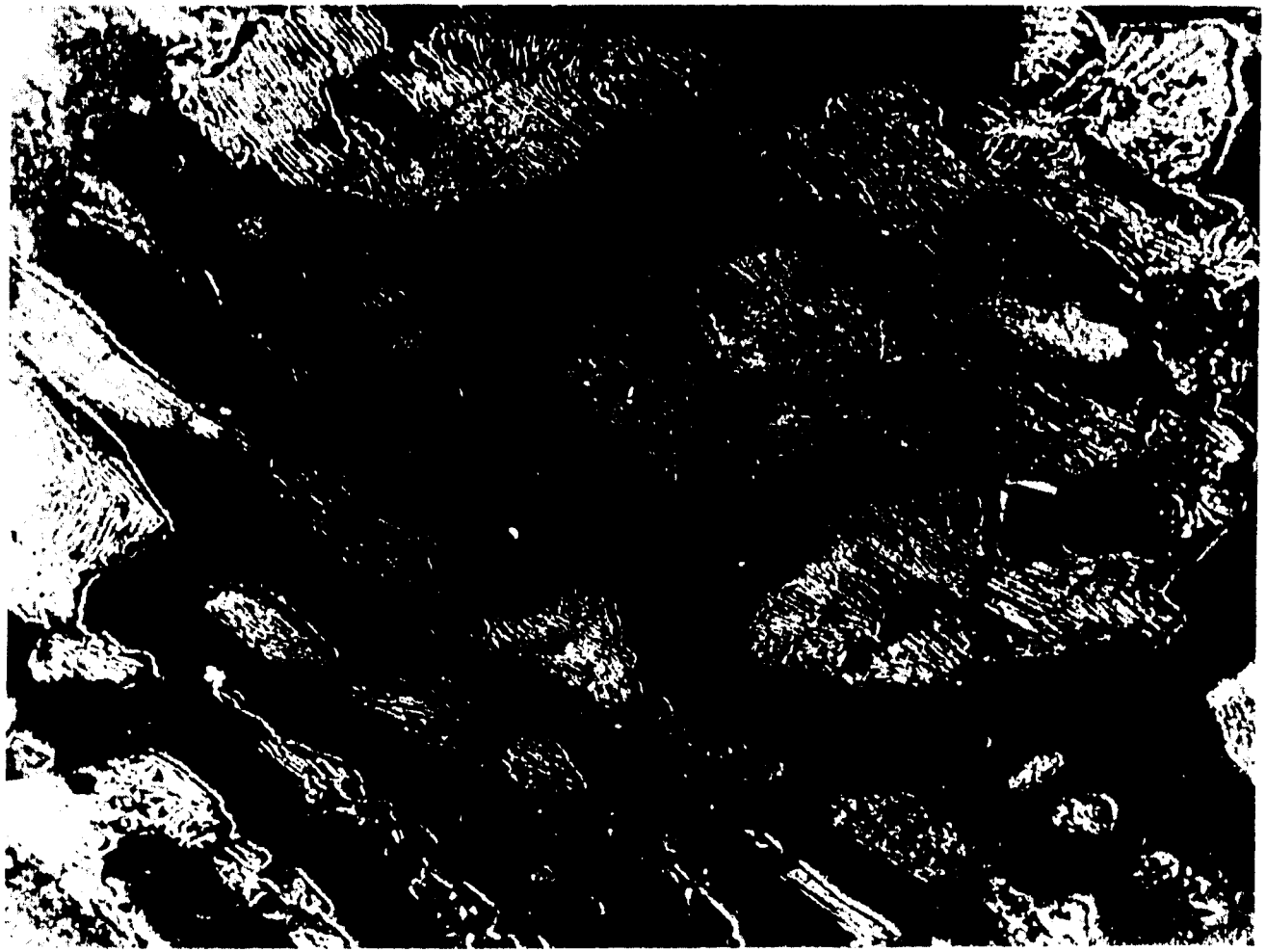
FIG. 1 is a scanning electron microscope (phase contrast mode) photomicrograph (1200×magnification) showing vanadium carbide (VC) precipitation in eutectic cementite $(Fe,V)_3C$, according to the process of the present invention.

In general, the process of the present invention includes the steps of:

(1) preparing a melt including
  (a) iron;
  (b) carbon; and
  (c) one or more alloying elements;
(2) cooling the melt at a rate of approximately 2° C. per minute or faster to form a white cast iron material;
(3) annealing the white cast iron material at a temperature of about 100° C. to about 400° C. below the solidus temperature of the white cast iron material;
(4) heating the white cast iron material to a temperature suitable for plastically deforming the white cast iron material; and
(5) plastically deforming the white cast iron material.

In a preferred aspect of the present invention the melt prepared during the above step (1) contains in addition to iron and carbon one or more alloying elements, which are preferably carbide-forming elements selected from the group consisting of manganese, chromium, molybdenum, tungsten, vanadium, titanium, niobium, tantalum, zirconium, hafnium, uranium, and mixtures thereof. In one preferred aspect, the upper limits of each of these alloying elements, is approximately as follows (expressed in percent by weight of the final composition):

| | |
|---|---|
| manganese | 12.0; |
| chromium | 12.0; |
| molybdenum | 6.3; |
| tungsten | 6.3; |
| vanadium | 3.3; |
| titanium | 3.3; |
| niobium | 1.5; |
| tantalum | 1.5; |
| zirconium | 1.5; |
| hafnium | 0.12; and |
| uranium | 0.12. |

It is believed that the appropriate amount of such alloying element is dependent upon the amount of carbon employed, which preferably ranges from about 2.0 to about 3.7 percent by weight of the final composition.

When employed, however, the above-noted alloying elements preferably are employed at concentration levels that vary according to the following formula:

$$E_1+1.49\ E_2+3.03\ E_3+5.88\ E_4+76.9\ E_5=(\text{from about } 1.51 \text{ to about } 3.27)\ E_6$$

Wherein:

$E_1$ is the concentration of elements selected from the group consisting of manganese, chromium and mixtures thereof;

$E_2$ is the concentration of elements selected from the group consisting of tungsten, molybdenum, and mixtures thereof;

$E_3$ is the concentration of elements selected from the group consisting of vanadium, titanium and mixtures thereof;

$E_4$ is the concentration of elements selected from the group consisting of niobium, tantalum, and mixtures thereof;

$E_5$ is the concentration of elements selected from the group consisting of hafnium, uranium, and mixtures thereof; and $E_6$ is the concentration of carbon.

The above concentrations, as all concentrations herein (unless otherwise noted), refer to percent by weight of the final composition.

In addition to the foregoing alloying elements, the composition and process of the present invention also contemplates the optional employment of elements selected from the group consisting of nickel, silicon, aluminum, and mixtures thereof. When employed, preferably the silicon is added in an amount of about 0.2 to about 1.5 percent; nickel is added in an amount of about 0.3 to about 10.0 percent; and aluminum is added in an amount of about 0.05 to about 0.5 percent.

In a particularly preferred embodiment, the composition includes iron, carbon in an amount of about 2.5–2.8%, vanadium in an amount of about 1.5–1.9%, chromium in an amount of up to about 0.7%, and nickel in an amount of up to about 0.3%.

The skilled artisan will also appreciate that minor amounts of other elements may be present, such as phosphorus, sulfur, etc.

Without intending to be bound by theory, it is believed that the addition of nickel, silicon, aluminum, or mixtures thereof (and preferably all three) will increase the density of dislocations which are free from isolation of special carbides, and thereby contribute to polygonization and recrystallization in cementite in a manner as outlined further herein. Also as outlined further herein, it is believed that the malleability of the white cast iron material is enhanced, at least in part, due to the resulting shear of cementite at grain and sub-grain boundaries.

In particular, without intending to be bound by theory, it is believed that nickel added to the melt in the above mentioned amounts displaces carbide forming elements from solid solution into cementite thereby increasing their effective concentration in cementite. Cementite decomposition during annealing is facilitated, and deformability of white cast iron is substantially enhanced.

Further, it is believed that alloying with nickel within the above specified limits enhances activity of carbon in the cast iron and helps to accelerate formation of precipitated more stable carbides (than the cementite) which are described further herein. In turn deformability of white cast iron is substantially enhanced. Preferably nickel is employed in an amount which would not promote graphite formation in cast iron during plastic deformation.

With respect to silicon, it is believed that it likewise increases carbon activity and helps to accelerate the formation of precipitated more stable carbides (than the cementite) which are discussed further herein.

It is believed that adding aluminum in the above specified amounts contributes to an increase in stresses at the base metal/cementite interface. This facilitates generation of dislocations in cementite and origination of carbides therein, and is believed to enhance deformability of the white cast iron.

Preferably, aluminum is employed in an amount which would not contribute to the formation of appreciable amounts of aluminum oxide that would impair processing of the material.

Preferably, the melt containing one or more of the above alloying elements is prepared in an induction-type furnace using techniques known in the art for melting in such furnaces. Of course, other known conventional techniques and furnaces may be employed, as the skilled artisan would appreciate.

After assimilation of the alloying elements into the melt, the melt is poured into suitable molds for preparing a solidified material or ingot. Preferably, the mold is part of a system that permits the melt to be cooled at a rate of at least about 2° C. per minute in the ingot core, as called for in the above step (2). In this manner, it is believed that the cementite (which is a metastable cementite phase oversaturated with the alloying elements) can be obtained in the resulting white cast iron material ingot. An example of a resulting ingot size is approximately 1200 kg.

As indicated, as called for in the above step (2) the melt is cooled preferably at a rate of at least about 2° C. per minute in the ingot core. In this regard, cooling rates as high as 30° C. per minute or higher are contemplated. Cooling rates as high as $10^{5}$° C. per minute are possible. Cooling may be accomplished using any suitable method known in the art, and may be varied according to the size and shape of the ingot.

As indicated by Step (3) above, after the ingot has solidified, it is annealed using conventional methods for a predetermined time at a temperature of about 100° to 400° C. below the solidus temperature of the material. Preferably, the annealing time is selected such that a sufficient opportunity will be provided for the accomplishment of reactions which are believed to occur during this step and which are discussed in greater detail herein. Accordingly, in a present preferred embodiment this annealing step is conducted for about two hours. In another embodiment of the present invention, it is also contemplated that the material may be annealed to as high as about 80° C. below the solidus of the material, but should not be so high as a deformation-impairing liquid would form.

Optionally a cooling step may be employed between the above steps (3) and (4). For instance it is possible to cool the annealed material at a rate and under conditions that would promote the formation of a pearlite in the structure.

The step (4) is preferably carried out at a temperature sufficient to facilitate plastic deformation of the material. Accordingly, the step (4) is preferably carried out at a temperature of about 850° C. to about 1150° C. More preferably, the temperature ranges from about 950° C. to about 1100° C., and still more preferably about 1000° C. to about 1050° C.

While the range of temperatures set forth herein are preferred, the skilled artisan will appreciate that such temperatures may be higher or lower. However, it is preferable that the temperature be sufficient to avoid the formation of microscopic voids or discontinuities or other products that would result in a lower strength or deformability of the resulting material. Further, the temperature preferably is such that localized fusion is avoided within the structure which may impair deformability.

Plastic deformation according to Step (5) preferably occurs at any suitable load, deformation amount per pass (e.g. up to about 15% deformation per pass or larger) and deformation rate. Deformation may be by reduction or by elongation. Thus, the load may be in compression or in tension, and may vary according to such factors of deformation as temperature, rate and amount desired. Deformation rates preferably range from about $10^{-3}$/sec to about $10^{3}$/sec, and more preferably about 1/sec to about 10/sec.

Further, any suitable equipment may be employed to deform the material including, but not limited to forging presses, bloom, slab, bar or rod mills; rotary elongating mills; piercing presses; tube rolls; or the like.

Plastically deformed articles may further be heat treated and cooled, as desired, in accordance with conventional techniques for achieving the desired ultimate microstructure.

The present process may be advantageously employed to mass produce numerous articles such as strip, bars, rods, sheets, pipes, slabs, mill rolls, tumbling balls, electrodes, or the like. Hollow drawn, wrought and machined articles are also contemplated. Such articles find particular advantageous use in environments such as sintering plants, plough shares, etc. Automotive components such as crankshafts and camshafts may likewise be advantageously manufactured in accordance with the process of the present invention. Specifically, it will be apparent from the above and the examples that white cast iron produced by the process according to the invention exhibits high malleability so that it even can be used for making such products as workrolls of 90 mm in diameter and larger, small-diameter bars, sheets 2 mm thick, wire of 2 mm in diameter, sheet rolling rolls of 6 mm in diameter and larger, in particular, workrolls for rolling CRT tape.

Cost savings should be realized due to the use of white cast iron in place of conventional steels.

Without intending to be bound by theory, it is believed that the deformability of the white cast iron material is improved by a mechanism occurring as a result of the combination of the compositions and the operating parameters employed, as described above. That is, following steps (1) and (2) is believed to result in the formation from the liquid melt of a metastable cementite (denoted as $M_3C$, wherein M refers to a compound of iron and one or more metal forming carbides) and austenite. Following the above steps 3–5, in turn, is believed to result in a further phase transformation wherein amounts of $M_3C$ are transformed to austenite, $Fe_3C$, and a carbide denoted as M'C, where M' typically refers to one or more of the carbide forming alloying elements in the composition. The carbide M'C preferably is a more stable carbide than is $M_3C$. Conventional processes are not believed to control for this phase transformation and not believed to use it advantageously to improve the plastic deformability of white cast iron.

More particularly, it is believed that upon further heating and plastic deformation (e.g. above-noted steps 3–5) a partial decomposition of the metastable "eutectic" cementite occurs, along with the further precipitation and growth of more stable phases (e.g., M'C). For example, it is believed that when heating to the temperatures referred to in the above step (3), stratification of the spinodal decomposition type occurs in cementite that is oversaturated with the alloying elements, and particularly the carbide forming alloying elements. Thus, zones are produced that are either rich in alloying elements or poor in alloying elements. Stresses caused by alpha-to-gamma transformations and differences between coefficients of thermal expansion of the phases appear within the boundary areas of cementite. They become pronounced in case of a wavy relief which is characteristic of ledeburite colonies and result in dislocations being generated in cementite.

In a physical sense, it is believed that loading (during plastic deformation) the white cast iron material contributes to the further formation and growth of dislocation bundles within the material and specifically located in the cementite. These dislocation bundles effectively function as sites for nucleation or precipitation of the more stable phases, like M'C, external of the cementite and, in many instances, adjacent thereto. The more stable carbides, many of which grow, tend to increase external stresses relative to the metastable cementite and likewise are believed to increase vacancy concentration. Meanwhile, as the more stable carbides grow, the density of the metastable cementite decreases. Dislocation motion within the material is facilitated.

As a result of the above, and under further loading, it is believed that the density of dislocations free from precipitates of the more stable carbide (e.g. M'C) increases such that, at some point, polygonization and recrystallization will occur in the cementite. Resulting shears on subgrain boundaries of cementite grains, in turn, leads to splitting of the grains and thereby facilitates plastic deformation.

The following examples illustrate the present invention.

EXAMPLES 1–41

An iron melt is prepared in an induction furnace. Carbide forming alloying elements are added to the melt, and the melt is allowed to assimilate 15 minutes. The melt is then poured into molds to obtain ingots by crystallization at a predetermined cooling rate.

The resulting ingots of 25 kg each are annealed for two hours and then slowly cooled. Specimens are then made from the ingots after their cooling, and these specimens are heated to 1050° C. and tested for hot torsion, and namely the number of revolutions (by torsion) of the sample until fracture.

Chemical composition of the resulting ingots, conditions for carrying out process operations, and test results are given in Table 1.

TABLE 1

| No. 1 | Chemical composition of ingots in % by weight (iron the balance) C 2 | Si 3 | P 4 | S 5 | Mn 6 | Cr 7 | W 8 | Mo 9 | V 10 | Ti 11 | Nb 12 | Ta 13 | Zr 14 | Hf 15 | U 16 | Cooling rate °C./min. 17 | Annealing temp. °C. 18 | Number of revolution until Fracture 19 |
|---|---|---|---|---|---|---|---|---|---|---|---|---|---|---|---|---|---|---|
| 1 | 2.71 | 0.49 | 0.07 | 0.04 | — | — | — | — | 2.0 | — | — | — | — | — | — | 2.0 | 1100 | 6.2 |
| 2 | 2.88 | 0.58 | 0.06 | 0.05 | 4.4 | — | — | — | — | — | — | — | — | — | — | — | (about 100° C. | 7.4 |
| 3 | 3.10 | 0.52 | 0.06 | 0.05 | 6.3 | — | — | — | — | — | — | — | — | — | — | 30 | below solidus) | 9.5 |
| 4 | 3.02 | 0.49 | 0.07 | 0.06 | 12.0 | — | — | — | — | — | — | — | — | — | — | 30 | | 7.5 |
| 5 | 2.85 | 0.56 | 0.07 | 0.04 | — | 4.5 | — | — | — | — | — | — | — | — | — | 30 | | 7.3 |
| 6 | 3.01 | 0.48 | 0.06 | 0.04 | — | 6.4 | — | — | — | — | — | — | — | — | — | 30 | | 9.3 |
| 7 | 3.20 | 0.51 | 0.06 | 0.04 | — | 12.0 | — | — | — | — | — | — | — | — | — | 30 | | 7.3 |
| 8 | 3.05 | 0.49 | 0.06 | 0.05 | — | — | 3.2 | — | — | — | — | — | — | — | — | 30 | | 8.0 |
| 9 | 2.92 | 0.41 | 0.06 | 0.05 | — | — | 4.5 | — | — | — | — | — | — | — | — | 30 | | 8.7 |
| 10 | 2.89 | 0.51 | 0.08 | 0.05 | — | — | 6.3 | — | — | — | — | — | — | — | — | 30 | 1000° | 8.7 |
| 11 | 2.79 | 0.58 | 0.05 | 0.04 | — | — | — | 2.9 | — | — | — | — | — | — | — | 30 | (about 200° C. | 8.1 |
| 12 | 2.89 | 0.48 | 0.06 | 0.04 | — | — | — | 4.6 | — | — | — | — | — | — | — | 30 | below solidus | 9.0 |
| 13 | 2.81 | 0.45 | 0.08 | 0.04 | — | — | — | 6.3 | — | — | — | — | — | — | — | 30 | | 8.2 |
| 14 | 2.61 | 0.52 | 0.06 | 0.04 | — | — | — | — | 1.4 | — | — | — | — | — | — | 30 | | 8.3 |
| 15 | 3.14 | 0.41 | 0.06 | 0.05 | — | — | — | — | 2.4 | — | — | — | — | — | — | 30 | | 9.2 |
| 16 | 3.10 | 0.43 | 0.06 | 0.05 | — | — | — | — | 3.3 | — | — | — | — | — | — | 30 | | 8.5 |
| 17 | 2.0 | 0.48 | 0.06 | 0.04 | — | — | — | — | 1.2 | — | — | — | — | — | — | 30 | | 7.5 |
| 18 | 3.65 | 0.35 | 0.08 | 0.04 | — | — | — | — | 2.4 | — | — | — | — | — | — | 30 | | 8.8 |
| 19 | 2.87 | 0.50 | 0.07 | 0.06 | — | — | — | — | — | 1.5 | — | — | — | — | — | 30 | | 6.9 |
| 20 | 2.92 | 0.58 | 0.07 | 0.06 | — | — | — | — | — | 2.4 | — | — | — | — | — | 30 | | 7.9 |
| 21 | 3.08 | 0.05 | 0.07 | 0.06 | — | — | — | — | — | 3.3 | — | — | — | — | — | 30 | 900° | 7.5 |
| 22 | 2.69 | 0.46 | 0.06 | 0.05 | — | — | — | — | — | — | 0.8 | — | — | — | — | 30 | (about 300° C. | 8.2 |
| 23 | 2.75 | 0.47 | 0.06 | 0.05 | — | — | — | — | — | — | 1.1 | — | — | — | — | 30 | below solidus | 9.8 |
| 24 | 2.83 | 0.44 | 0.06 | 0.05 | — | — | — | — | — | — | 1.5 | — | — | — | — | 30 | | 9.6 |
| 25 | 2.59 | 0.55 | 0.07 | 0.05 | — | — | — | — | — | — | — | 0.8 | — | — | — | 30 | | 7.5 |
| 26 | 2.89 | 0.45 | 0.05 | 0.04 | — | — | — | — | — | — | — | 1.1 | — | — | — | 30 | | 9.9 |
| 27 | 2.83 | 0.48 | 0.05 | 0.04 | — | — | — | — | — | — | — | 1.5 | — | — | — | 30 | | 9.6 |
| 28 | 3.07 | 0.44 | 0.06 | 0.04 | — | — | — | — | — | — | — | — | 0.9 | — | — | 30 | | 6.8 |
| 29 | 2.48 | 0.55 | 0.06 | 0.04 | — | — | — | — | — | — | — | — | 1.2 | — | — | 30 | | 7.7 |
| 30 | 2.55 | 0.57 | 0.06 | 0.04 | — | — | — | — | — | — | — | — | 1.3 | — | — | 30 | | 7.3 |
| 31 | 2.83 | 0.37 | 0.05 | 0.05 | — | — | — | — | — | — | — | — | — | 0.06 | — | 30 | 800° | 7.0 |
| 32 | 2.72 | 0.40 | 0.05 | 0.05 | — | — | — | — | — | — | — | — | — | 0.09 | — | 30 | (about 400° C. | 8.5 |
| 33 | 2.99 | 0.35 | 0.05 | 0.05 | — | — | — | — | — | — | — | — | — | 0.12 | — | 30 | below solidus | 8.5 |
| 34 | 2.45 | 0.48 | 0.06 | 0.05 | — | — | — | — | — | — | — | — | — | — | 0.05 | 30 | | 7.3 |
| 35 | 2.53 | 0.51 | 0.06 | 0.04 | — | — | — | — | — | — | — | — | — | — | 0.09 | 30 | | 8.8 |
| 36 | 2.47 | 0.53 | 0.06 | 0.04 | — | — | — | — | — | — | — | — | — | — | 0.02 | 30 | | 8.4 |
| 37 | 3.20 | 0.45 | 0.05 | 0.04 | 0.5 | 0.8 | — | — | 2.3 | — | — | — | — | — | — | 30 | | 9.8 |
| 38 | 2.75 | 0.49 | 0.05 | 0.04 | 0.4 | 0.6 | — | — | 0.8 | 0.5 | 0.4 | — | — | — | — | 30 | | 9.7 |
| 39 | 2.89 | 0.55 | 0.05 | 0.04 | 0.4 | 0.6 | 0.5 | 0.5 | 0.3 | 0.2 | 0.2 | 0.2 | — | 0.03 | — | 30 | | 9.5 |
| 40 | 2.87 | 0.39 | 0.05 | 0.04 | 0.4 | 0.6 | 0.4 | 0.4 | 0.2 | 0.2 | 0.2 | 0.1 | — | 0.02 | 0.01 | 30 | | 9.9 |
| 41 | 2.70 | 0.48 | 0.07 | 0.04 | — | 0.5 | — | — | 1.5 | — | — | — | — | — | — | 2.0 | 1100° (about 100° C. below solidus) | 6.3 |

Figure 2:
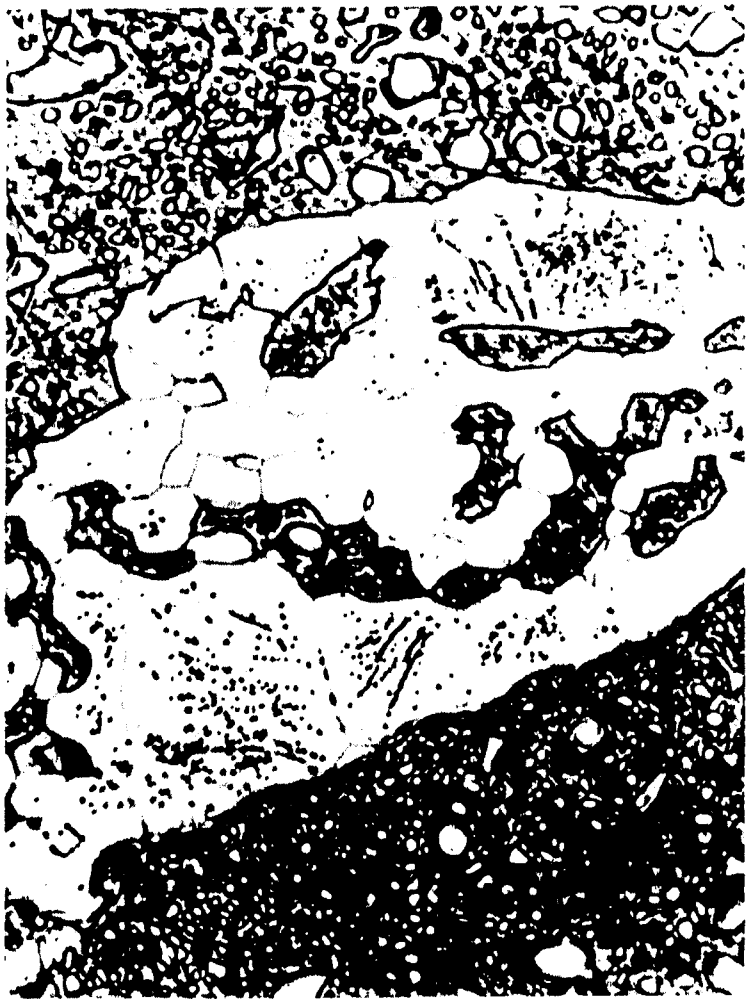
FIG. 2 is a photomicrograph (2000×magnification) showing microstructural changes during plastic working of white cast iron containing vanadium according to the process of the present invention.
Figure 3:
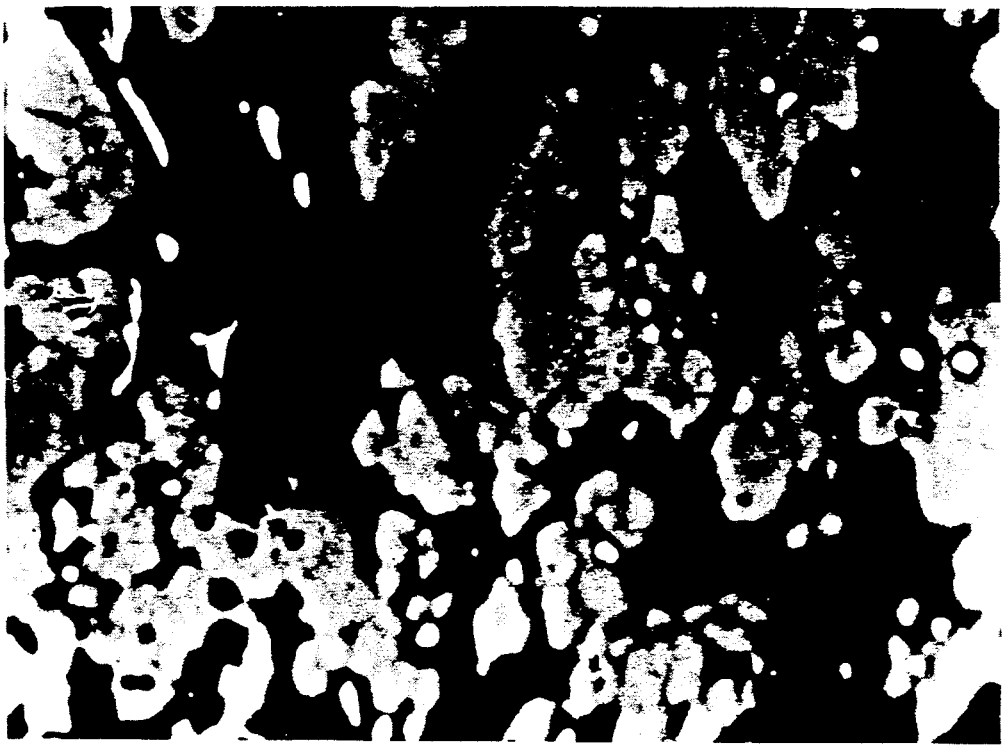
FIG. 3 is a photomicrograph (1800×magnification) showing segmentation of cementite along subgrain boundaries during deformation according to the process of the present invention.

FIGS. 1 through 3 show the microstructure of a white cast iron, containing vanadium, prepared according to the process of the present invention, and having a composition like in formula 37 of Table 1. FIG. 1 represents the structure at a point during the early stage of plastic deformation. FIG. 2 shows a generally intermediate step. FIG. 3 shows a later step. In FIGS. 1 and 2, vanadium carbide is shown as relatively small dark bodies. In FIG. 3, the vanadium carbide appears as relatively small light bodies.

As shown in FIG. 1, the phases that appear include metastable cementite $(Fe,V)_3C$ (darker background), pearlite, and vanadium carbide (VC). The phases that appear in FIG. 2 include ferrite (greyish background), spheroidal pearlite, metastable carbide (the light granular structure toward the central portion of the micrograph), and vanadium carbide. The phases that appear in FIG. 3, in turn, are metastable carbide (showing as larger light bodies), austenite (as dark background) and vanadium carbide (as smaller relatively rounded light bodies).

EXAMPLES 42–47

Carbide forming elements soluble in cementite and selected from the group of (by chemical symbol) Mn, Cr, Mo, W, V, Ti, Nb, Ta, Zr, Hf, and U and mixtures thereof, are added to a melt of iron and carbon.

At the same time, Ni, Si, and Al are added individually or in combinations to the melt.

The resulting melt is allowed to assimilate for 15 minutes, and is then poured into molds to obtain ingots. The resulting 25 kg ingots are individually annealed at 950° C. (which is about 250° C. below solidus) for two hours and slowly cooled to form pearlite. This operation may be repeated many times for preparation of the white cast iron structure for plastic deformation. The ingots are then heated to 1050° C. and formed on a forging hammer. The deformed ingots are then cooled to a temperature of about 80° to about 400° C. below the solidus temperature for a time sufficient to relieve stresses in the deformed ingot.

Plastic deformation of the deformed ingot, heated to the above specified temperature, is then carried out. The ingot is then cooled.

The amounts of Ni, Si, Al added, chemical composition of the resulting ingots, and conditions of process steps are given in Table 2.

TABLE 2

| | Amount of added element | | | Chemical composition of white iron in weight %, iron the balance | | | | | | | | | | | | | | |
|---|---|---|---|---|---|---|---|---|---|---|---|---|---|---|---|---|---|---|
| No 1 | Ni 2 | Si 3 | Al 4 | C 5 | Ni 6 | Si 7 | Al 8 | Mn 9 | Cr 10 | Mo 11 | W 12 | V 13 | Ti 14 | Nb 15 | Ta 16 | Zr 17 | Hf 18 | U 19 |
| 42 | 0.3 | — | — | 3.10 | 0.3 | — | — | 0.4 | 3.0 | — | 0.5 | — | — | — | — | — | — | — |
| 43 | 0.3 | — | — | 2.70 | 0.3 | — | — | — | 0.5 | — | 1.5 | — | — | — | — | — | — | — |
| 44 | 10.0 | 0.2 | 0.05 | 3.05 | 9.6 | 0.4 | 0.04 | 0.2 | 0.2 | 0.2 | 0.2 | 3.3 | 0.1 | 0.05 | 0.05 | 0.05 | 0.01 | 0.01 |
| 45 | 5.0 | — | 0.5 | 3.02 | 5.0 | — | 0.4 | — | — | 0.5 | 3.2 | — | — | — | — | — | — | — |
| 46 | — | 1.5 | — | 2.99 | — | 1.5 | — | 0.2 | — | — | — | 2.4 | — | — | — | — | — | — |
| 47 | — | — | 0.2 | 2.96 | — | — | 0.18 | 0.4 | — | — | — | — | — | 1.5 | — | — | — | — |

| No 1 | Heating temperature for deformed ingot before deformation, °C. 20 | Cure, min 21 | Yield limit, MPa 22 | Relative elongation 23 |
|---|---|---|---|---|
| 42 | 1120 (80° C. below solidus) | 30 | 500 | 6.8 |
| 43 | 1120 (80° C. below solidus) | 30 | 530 | 6.9 |
| 44 | 1100 (100° C. below solidus) | 40 | 520 | 7.0 |
| 45 | 800 (400° C. below solidus) | 120 | 500 | 6.9 |
| 46 | 950 (250° C. below solidus) | 100 | 545 | 7.0 |
| 47 | 1000 (200° C. below solidus) | 100 | 542 | 7.0 |

It is to be understood that the invention is not limited to the exact construction or process illustrated and described above, but that various changes and modifications may be made without departing from the spirit and scope of the invention as defined in the following claims.

What is claimed is:

1. A process for plastically deforming a white cast-iron, said process comprising the steps of:
   (a) preparing a melt consisting essentially of:
      (i) about 2.0 to about 3.7 percent by weight of carbon;
      (ii) vanadium in an amount of about 1.5 to about 1.9 percent by weight; and
      (iii) the balance iron;
   (b) cooling said melt at a rate of at least about 30° C. per minute for forming a white cast-iron material having a structure including a metastable cementite phase;
   (c) annealing said white cast-iron material at a temperature of about 100° C. to about 400° C. below its solidus temperature for transforming said metastable cementite phase and forming a structure including $Fe_3C$ and vanadium carbide, said vanadium carbide being more stable than said metastable carbide; wherein the amount of said metastable cementite phase that is transformed is sufficient to permit plastic deformation of said white cast iron at a temperature as low as about 850° C., and at a deformation rate ranging from about 1/sec to about 10/sec; and
   (d) then plastically deforming said white cast-iron material at a temperature as low as about 850° C., and at a deformation rate ranging from about 1/sec to about 10/sec.

2. A process according to claim 1 wherein said carbon is present in an amount of about 2.5 to about 2.8 percent by weight.

3. A process according to claim 1 further comprising adding chromium to said melt in an amount up to about 0.8 percent by weight and nickel in an amount up to about 0.3 percent by weight.

4. A process according to claim 3 further comprising adding manganese to said melt in an amount of about 0.5 percent by weight.

5. A process for plastically deforming a white cast-iron, said process comprising the steps of:
   (a) preparing a melt consisting essentially of:
      (i) about 2.0 to about 3.7% by weight of carbon;
      (ii) at least one carbide-forming element selected from the group consisting of manganese, chromium, molybdenum, tungsten, vanadium, titanium, niobium, tantalum, zirconium, hafnium, uranium and mixtures thereof, wherein the amount of said carbide-forming element is selected in accordance with the formula:

$$E_1+1.49\,E_2+3.03\,E_3+5.88\,E_4+76.9\,E_5=(\text{about } 1.51 \text{ to about } 3.27)\,E_6;$$

wherein:

$E_1$ is the concentration of elements selected from the group consisting of manganese, chromium and mixtures thereof;

$E_2$ is the concentration of elements selected from the group consisting of tungsten, molybdenum, and mixtures thereof;

$E_3$ is the concentration of elements selected from the group consisting of vanadium, titanium and mixtures thereof;

$E_4$ is the concentration of elements selected from the group consisting of niobium, tantalum, and mixtures thereof;

$E_5$ is the concentration of elements selected from the group consisting of hafnium, uranium, and mixtures thereof; and $E_6$ is the concentration of carbon; and (iii) the balance iron;

(b) cooling said melt at a rate of at least about 2° C. per minute for forming a white cast-iron material having a structure with a metastable cementite ($M_3C$) phase;

(c) annealing said white cast-iron material at a temperature of about 100° C. to about 400° C. below the solidus temperature of said white cast-iron material for transforming said metastable cementite phase and forming a structure containing $Fe_3C$, and a carbide denoted as M'C where M' is at least one of said carbide-forming elements, wherein said M'C is a more stable carbide than said $M_3C$, wherein the presence of said M'C facilitates plastic deformation of said white cast iron; and further wherein the amount of said metastable cementite phase that is transformed is sufficient to permit plastic deformation of said white cast iron at a temperature as low as about 850° C., and at a deformation rate ranging from about 1/sec to about 10/sec; and (d) then plastically deforming said white cast iron material having said M'C at a temperature as low as about 850° C., and at a deformation rate ranging from about 1/sec to about 10/sec.

6. A process according to claim 5 wherein said carbon is present in an amount of about 2.5 to about 2.8 percent, and said carbide forming alloying element is vanadium in an amount of about 1.5 to about 1.9 percent.

7. A process according to claim 5 further comprising chromium in an amount up to about 0.8 percent, and nickel in an amount up to about 0.3 percent.

8. A process according to claim 5 wherein the amount of said carbide-forming element is up to about 12.0 weight percent manganese, up to about 12.0 weight percent chromium, up to about 6.3 weight percent molybdenum, up to about 6.3 weight percent tungsten, up to about 3.3 weight percent vanadium, up to about 3.3 weight percent titanium, up to about 1.5 weight percent niobium, up to about 1.5 weight percent tantalum, up to about 1.5 weight percent zirconium, up to about 0.12 weight percent hafnium, and up to about 0.12 weight percent uranium.

* * * * *